United States Patent [19]

Frank

[11] 4,409,902

[45] Oct. 18, 1983

[54] SPIKE DRIVERS

[75] Inventor: Earl E. Frank, Tallman, N.Y.

[73] Assignee: Abex Corporation, New York, N.Y.

[21] Appl. No.: 255,647

[22] Filed: Apr. 20, 1981

[51] Int. Cl.[3] ..... E01B 29/26

[52] U.S. Cl. ..... 104/17 R; 137/637

[58] Field of Search ..... 104/17 R, 17 A, 7 R; 173/125, 90; 92/165 R, 165 PR; 227/110, 111, 139, 140, 147; 308/3 R; 254/18, 30; 137/636, 637; 384/154, 432

[56] References Cited

U.S. PATENT DOCUMENTS

| | | | |
|---|---|---|---|
| 2,910,010 | 10/1959 | Godfrey et al. | 104/17 R |
| 2,925,048 | 2/1960 | McWilliams et al. | 104/17 R |
| 2,980,140 | 4/1961 | McMillan | 137/637 |
| 3,010,407 | 11/1961 | Godfrey et al. | 104/17 R |
| 4,069,763 | 1/1978 | Theurer | 104/7 R |

*Primary Examiner*—Robert B. Reeves
*Assistant Examiner*—Richard Mathieu
*Attorney, Agent, or Firm*—Kinzer, Plyer, Dorn & McEachran

[57] ABSTRACT

A pair of air-operated hammers for driving railroad spikes are guided by separate yokes, raised and lowered by trunnion-mounted cylinders; a cross frame in a vertical plane is supported between the hammers and clamps join upright guides to the crossframe, the clamps enabling the hammers to be laterally adjusted on a main frame.

3 Claims, 4 Drawing Figures

Figure 4:
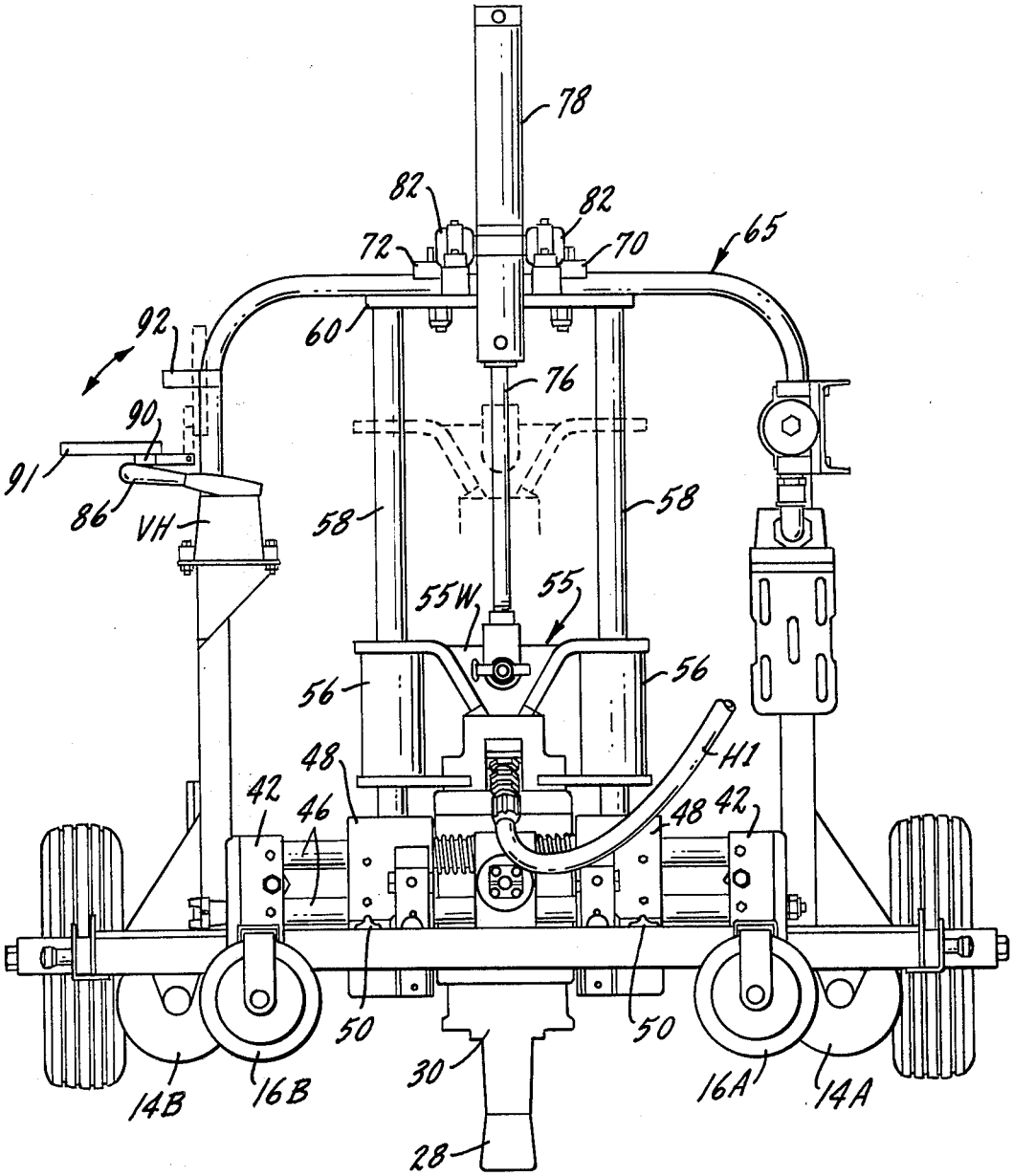

Fig. 1.
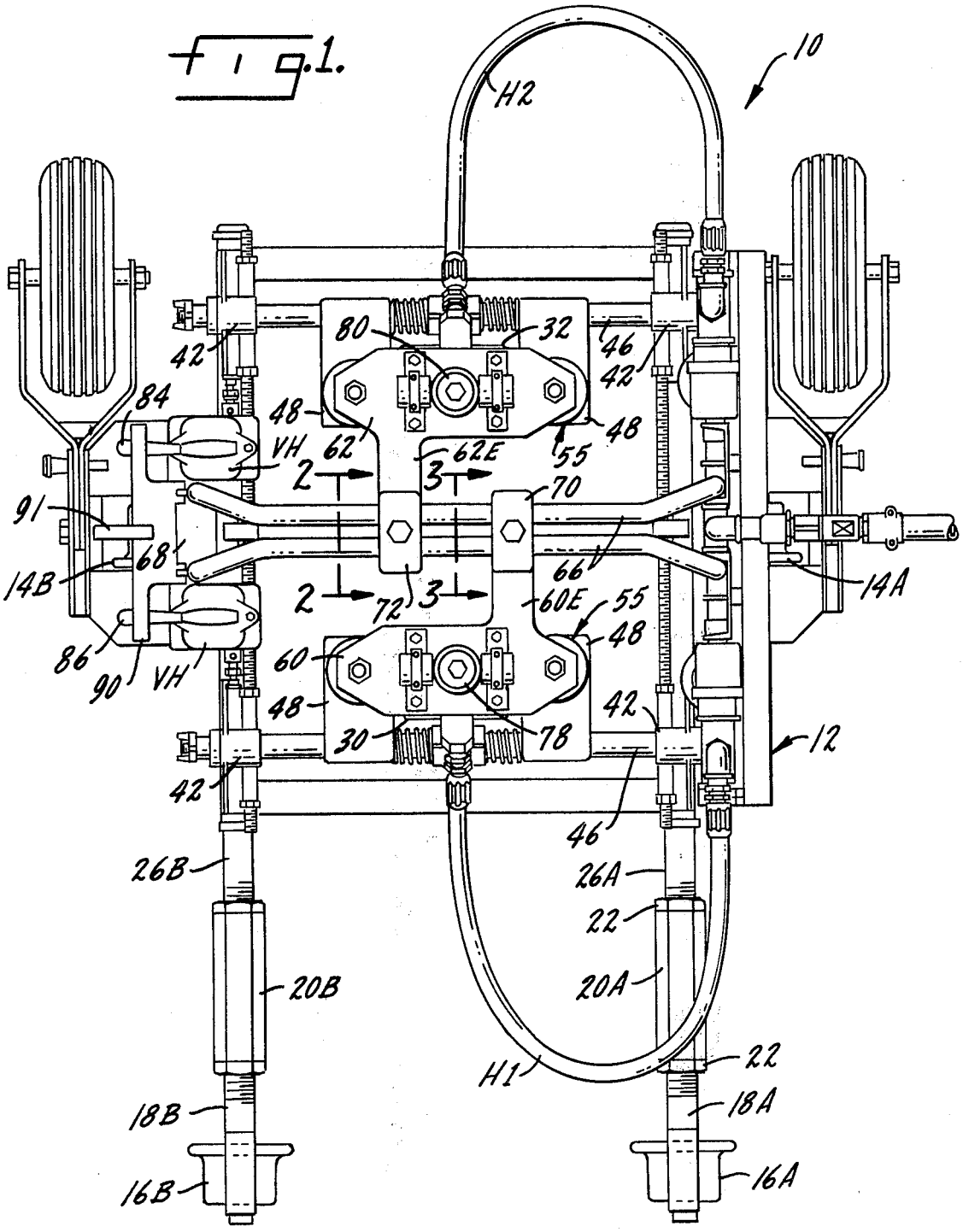
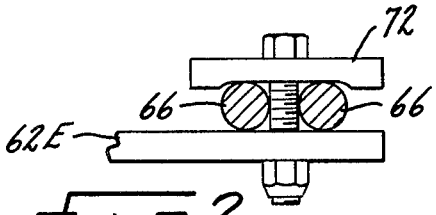
Fig. 2.
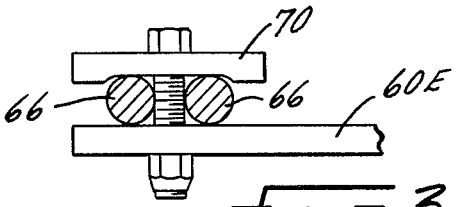
Fig. 3.

SPIKE DRIVERS

This invention relates to a spike driver for driving railroad spikes and specifically relates to the spike driver of U.S. Pat. No. 3,010,407.

The spike driver disclosed in the above patent has been eminently satisfactory but nonetheless the objects of the present invention are to further improve the performance of that spike driver. Specifically, the objects of the present invention are to enable repairs to be more easily accomplished, to eliminate parts which tend to seize or freeze, to enable adjusted positions to be more securely held and stabilized and to allow selection in modes of operation.

In the drawing:

FIG. 1 is a plan view of the spike driver;

FIGS. 2 and 3 are detail views on the lines 2—2 and 3—3 of FIG. 1;

FIG. 4 is an end view of the spike driver taken on the near side as viewed in FIG. 1.

The spike driver 10, FIG. 1, is of the kind disclosed in U.S. Pat. No. 3,010,407 and a horizontal, rectangular main frame 12 which supports one pair of flanged rail-engaging wheels 14A and 14B and a second set of flanged rail-engaging wheels 16A and 16B. As viewed in FIG. 1, the spike driver when mounted on the rails would be traveling from left to right.

The flanged rail-engaging wheels 16A and 16B are journaled for rotation on a pair of axles 18A and 18B having inner ends threadedly joined to respective turn buckles 20A and 20B, combined with jamb nuts 22.

The threaded ends of the turn buckles 20A and 20B opposite the wheels 16A and 16B are threadedly connected, along with the related jamb nuts, to axle extensions 26A and 26B in turn rigidly supported on the main frame.

The spikes for securing the flanges of the rails to the tie plates and to the tie are driven by a pair of compressed air hammers and the operating head of one such hammer is identified by reference character 28 in FIG. 4 where the related hammer 30 is shown in the lowered position ready for action. In the active mode, compressed air is communicated to the hammer 30 through a hose H1 under control of a related 4-way valve as will be explained in more detail below.

At the opposite side of the horizontal frame there is another hammer 32, FIG. 1, having a hose H2 for communicating compressed air thereto from the related 4-way valve as will be described.

Since the hammers may be activated together to drive a pair of spikes simultaneously, one spike on each side of the rail on which the wheels 14A and 14B are riding, FIG. 1, the hammers are supported for selective adjustment in the direction parallel to the rail, depending upon the rail system. To this end, to the end of allowing adjustment of one hammer relative to the other in the direction of the rail, a pair of brackets as 42, FIG. 4, support the opposite ends of a pair of vertically spaced, horizontally extending guide tubes 46.

Slidably mounted on the horizontal guide tubes 46 are a pair of slides 48 and as will be apparent in FIG. 4, the hammer 30 is centered between the slides 48 so that the position of the hammer is set by the slides. In this connection, the slides 48 are adapted to be secured tightly in the adjusted position by a pair of lock screws having handles or knobs 50 with the opposite ends adapted to bear tightly against sides of the horizontal frame 12.

Each hammer as 30, FIG. 4, is bolted to the underside of a large support yoke 55 fabricated from individual castings as a one-piece yoke. The yoke 55 includes a pair of large bushings 56 slidably fitted to a pair of parallel, upright guide tubes 58. The guides 58 at their lower ends are supported by the slides 48 and at their upper ends are joined by a crosshead plate 60.

The arrangement of guides as 46, slides as 48, a yoke as 55, guides 58 and crosshead plate 60 is duplicated for the other hammer as will be evident from FIGS. 1 and 4 and hence a description concerning the support and adjustment for hammer 32 need not be set forth, except to note that the crosshead plate associated with hammer 32 is identified by reference character 62 in FIG. 1.

Further, to hold the hammers in an adjusted position and to lend additional support to the upright guide tubes 58, a clamp may be applied to the crosshead plates 60 and 62 and the manner in which this is accomplished will now be explained. As best shown in FIG. 4, a large header 65, comprising a pair of generally parallel tubes 66, as shown in FIG. 1, is positioned above the hammers and is rigidly attached to parts attached to the main frame 12 including end posts as 68, FIG. 1.

The crosshead plates 60 and 62 are provided with long ears 60E and 62E, FIG. 1, extending beneath the header bars 66. A clamp plate 70, and 72, is positioned on top of the header bars 66 enabling the header plate extension ears to be rigidly clamped to the header bar structure as shown in FIGS. 2 and 3.

The stored or inactive position for the hammers is shown by dashed line in FIG. 4. When the hammers are to be employed, they are dropped to the active position shown in full line. This is accomplished by an air-operated piston 76 (one for each hammer together with the related cylinder and associated parts to be described). The piston at its lower end is shackled to a medial web 55W included as part of the yoke casting assembly so that in effect the piston 76 is coupled to the related hammer.

The piston 76 operates inside a cylinder 78. The cylinder is centered within an opening in the cross plate 60 and it is provided with a pair of stubs on opposite sides, above the plate 60, enabling the cylinder to be trunnion-mounted and supported by trunnion mounts 82 secured on the upper surface of the cross plate 60. The cylinder related to the piston for hammer 32 is shown by reference character 80 in FIG. 1.

It will be seen from the foregoing that the piston 76 and its cylinder 78 are readily available for repair if necessary and because of the trunnion support 82—82 there will be no wear on the piston or cylinder due to uneven travel during the course of dropping the hammer to its active postion or raising it to the dashed line, stored position, FIG. 4. Also, the clamp plate (70 or 72) not only serves as an aid in holding the adjusted position of the hammer, but also stabilizes the guides 58.

Compressed air is allowed to flow to the hammers by depressing related handles 84 and 86, FIG. 1, actuating a 4-way valve (not shown) inside a related valve housing VH. To enable the valve handles to be depressed in unison so that both hammers may be operated concurrently, a bail 90 is pivotally mounted on the frame in position to span both valve handles. The bail at its midpoint is provided with a short handle 91 and a clip 92 is provided on the cross frame to hold the bail handle 91 in its stored or upright position shown by dashed line in FIG. 4. Thus in the stored or inactive position, the 4-way valve handles 84 and 86 may be operated selectively to operate one hammer or the other but by depressing the bail to engage it with the valve handles, the latter may be actuated in unison so that both hammers can be actuated concurrently.

It will be seen from the foregoing that the bail 90 permits the hammers to be actuated selectively or together, that the extensions on the crossheads 60 and 62 combined with the clamp plates 70 and 72 enable the hammers firmly to be locked in the adjusted position parallel to the rail direction, that the yokes 55 allow the hammers to be so hung and guided that there is little chance for binding (and at the same time the parts are accessible for inspection), that the outrigger wheels are easily adjusted for track gage and that the trunnion support for the hammer lift cylinders enables easy maintenance.

I claim:

1. In a railroad spike driver having two pairs of rail-engaging wheels for travel down the track, of which the wheels in one pair are supported each by an outrigger, and including a horizontal main frame supporting said outriggers together with a pair of independently operable air-operated hammers each for adjustment in the direction parallel to the railroad track, the improvements comprising:

a pair of yoke castings, one for each hammer, including a pair of laterally spaced guide bushings;

a pair of upright guides supported on the main frame at opposite sides thereof and on which a related pair of yoke bushings is slidably mounted for up and down movement incidental to raising and lowering each hammer;

a pair of cylinders each supported by related of said upright guides, each cylinder having its piston connected to the related yoke whereby each yoke may be raised or lowered by controlling flow of fluid under pressure to the related cylinder;

a cross frame in a vertical plane supported by the main frame in a position between the hammers, and respective clamp means joining the respective upright guides to the cross frame so that by opening a clamp means the related yoke casting and hammer supported thereby may be laterally adjusted on said main frame.

2. A railroad spike driver according to claim 1 including individual valves having operating handles for selectively controlling the flow of compressed air to the hammers, a single bail engageable with both handles allowing the valves to be operated in unison when the bail is applied in unison to the handles, a pivot support for said bail, and means to hold the bail in an inoperable position on the pivot so that either hammer may be operated selectively without operating the other handle.

3. A railroad spike driver according to claim 2 in which each cylinder is supported by a trunnion on a plate joining the related pair of upright guides.

* * * * *